United States Patent [19]

Masumoto, deceased et al.

[11] Patent Number: 4,814,027

[45] Date of Patent: Mar. 21, 1989

[54] FE-PT-NB PERMANENT MAGNET WITH AN ULTRA-HIGH COERCIVE FORCE AND A LARGE MAXIMUM ENERGY PRODUCT

[75] Inventors: Hakaru Masumoto, deceased, late of Sendai; Kiyoshi Watanabe, Sendai; Hiroshi Matushima, executor, Tokyo, all of Japan

[73] Assignee: The Foundation: The Research Institute of Electric and Magnetic Alloys, Sendai, Japan

[21] Appl. No.: 171,743

[22] Filed: Mar. 22, 1988

[30] Foreign Application Priority Data

Apr. 30, 1987 [JP] Japan ..... 62-104376

[51] Int. Cl.[4] ..... H01F 1/04

[52] U.S. Cl. ..... 148/300; 148/430; 420/466

[58] Field of Search ..... 148/300, 430; 420/466

[56] References Cited

U.S. PATENT DOCUMENTS 3,444,012 5/1969 Shimizu et al. ..... 420/466

4,396,441 8/1983 Masumoto et al. ..... 148/300

FOREIGN PATENT DOCUMENTS 38-8557 6/1963 Japan ..... 420/466

OTHER PUBLICATIONS

"A New Heat-Treatment of Pt—Co Alloys of High--Grade Magnetic Properties", by H. Kaneko et al., vol. 9, 1968, pp. 124–129.

"Constitution of Binary Alloys Fe—Pt", pp. 698–700, 1958.

*Primary Examiner*—John P. Sheehan

*Attorney, Agent, or Firm*—Parkhurst, Orliff & Berridge

[57] ABSTRACT

The disclosed permanent magnet has a coercive force of larger than 500 Oe, a residual magnetic flux density of larger than 5 kG, and a maximum energy product of larger than 2 MGOe, and it consisting essentially of 48~66.9 Atm % of iron, 33~47 Atm % of platinum, and 0.1~10 Atm % of niobium. It includes a crystal structure of an incomplete single $\gamma_1$ phase of a face-centered tetragonal system due to either the composition thereof or heat treatment applied thereto. The permanent magnet is made by heating an alloy of the above main composition at 900°~400° for one minute to ten hours and quenching the alloy at a high speed of faster than 30° C./minute but slower than 2,000° C./sec.

2 Claims, 5 Drawing Sheets

Coercive Force Hc

Residual Magnetic Flux Density Br

FE-PT-NB PERMANENT MAGNET WITH AN ULTRA-HIGH COERCIVE FORCE AND A LARGE MAXIMUM ENERGY PRODUCT

BACKGROUND OF THE INVENTION

1. Field of the Invention

This invention relates to a permanent magnet consisting of major ingredients of iron, platinum and niobium, with less than 0.5 atomic (Atm) % of impurities, which permanent magnet has an ultra-high coercive force and a very large maximum energy product.

2. Description of the Prior Art

As to conventional permanent magnets which use the order-disorder lattice phase transformation, Co-Pt alloys of even content in terms of number of atoms are known. With the Co-Pt alloys, an ultra-high coercive force and a very large maximum energy product can be obtained in the initial stage of transformation from a disordered $\alpha$ phase lattice into an ordered $\gamma_1$ phase lattice, which transformation can be caused either by cooling of the alloy of $\alpha$ phase at a high temperature of about 1,000° C. with a constant cooling speed followed by reheating at about 600° C., or by water quenching followed by reheating.

The conventional Co-Pt alloy demonstrates better magnetic properties as compared with other alloys, but it has a shortcoming in that, since its ferromagnetic atom is cobalt whose magnetic moment is smaller than that of iron, there are limits in its magnetic properties; namely, its residual magnetic flux density is limited to 7.2 kG (kilo·Gauss) and its maximum energy product is limited to 12 MGOe (Mega·Gauss·Oersted).

To overcome the above small magnetic moment, one may think of replacing cobalt in the alloy composition with iron having a large magnetic moment. However, with conventional Fe—50Pt (50 Atm % of Pt) alloys, the transformation temperature from ordered the lattice of $\gamma_1$ phase to the disordered $\gamma$ phase is very high, being about 1,320° C., and even a quick cooling, such as water quenching, results in a fairly well ordered lattice in an over-aged state. Thus, good magnetic properties cannot be produced by mere replacing of cobalt with iron.

SUMMARY OF THE INVENTION

Therefore, an object of the invention is to obviate the above-mentioned shortcoming of the Fe—50Pt alloys of the prior art by providing an excellent permanent magnet of Fe—Pt alloy system while improving the reproducibility of its magnetic properties.

Another object of the invention is to provide a method for producing the above permanent alloy of Fe—Pt system.

As a result of research efforts to solve the above shortcoming of the prior art, the inventors have found that an increase in the concentration of iron in the Fe—Pt alloy tends to reduce the order-disorder transformation point to about 800° C. and to facilitate fairly easy formation of disordered lattice of $\gamma$ phase. More particularly, the inventors have succeeded in developing a method in which quenching of an alloy of specific composition prevents quick growth of ordered lattice, so as to provide a laerge maximum energy product and an ultra-high coercive force by using an initial stage of the transformation to the ordered lattice of $\gamma_1$ phase Or by using homogeneous fine precipitation of $\gamma_1$ phase in the matrix of $\gamma$ phase.

The invention is based on the above finding of the inventors, and it further improves the fairly good magnetic properties of Fe—Pt alloys and ensures a highly dependable reproducibility of such improved magnetic properties.

A preferred embodiment of the permanent magnet of the invention consists of 48~66.9 Atm % of iron, 33~47 Atm % of platinum, 0.1~10 Atm % of niobium, and less than 0.5 Atm % of impurities. The crystal structure of the permanent magnet may include an incomplete $\gamma_1$ single phase of a face-centered tetragonal system due to either the composition thereof or heat treatment applied thereto. Instead of the above single phase, the permanent magnet may have a two-phase crystal structure formed of a $\gamma_1$ phase matrix of face-centered cubic system and homogeneously dispersed fine precipitate of $\gamma_1$ phase. The permanent magnet of the invention has a coercive force of larger than 500 Oe (Oersted), a residual magnetic flux density of larger than 5 kG, and a maximum energy product of larger than 2 MGOe.

In a method for producing a permanent magnet according to the invention, an alloy consisting of 48~66.9 Atm % of iron, 33~47 Atm % of platinum, 0.1~10 Atm % of niobium, and less than 0.5 Atm % of impurities is heated at 900°~1,400° C. for one minute to ten hours so as to apply a homogenizing solid solution treatment thereto, and the heated alloy is quenched at a high speed cooling rate of faster than 30° C./minute but slower than 2,000° C./second, so that the thus produced permanent magnet has a large maximum energy product and an ultra-high coercive force.

In another method for producing a permanent magnet having a large maximum energy product and an ultra-high coercive force according to the invention, an alloy consisting of 48~66.9 Atm % of iron, 33~47 Atm % of platinum, 0.1~10 Atm % of niobium, and less than 0.5 Atm % of impurities is heated at 900°~1,400° C. for one minute to ten hours so as to apply a homogenizing solid solution treatment thereto, and the heated alloy is quenched at a high speed of faster than 30° C./minute but slower than 2,000° C./second, and then the quenched alloy is reheated at 450°~800° C. for one minute to 500 hours, which reheating is followed by cooling.

In an embodiment of the method of the invention for producing a permanent magnet having a large maximum energy product and an ultra-high coercive force, the above alloy consisting of 48~66.9 Atm % of iron, 33~47 Atm % of platinum, 0.1~10 Atm % of niobium, and less than 0.5 Atm % of impurities is heated at 900°~1,400° C. for one minute to ten hours so as to apply a homogenizing solid solution treatment thereto, and the heated alloy is quenched at a high speed of faster than 30° C./minute but slower than 2,000° C./second. Plastic working is applied to the quenched alloy at a reduction ratio of larger than 80%, for instance by wire-drawing or rolling, and the worked alloy is reheated at 450°~800° C. for one minute to 500 hours and cooled thereafter.

What is meant by the above incomplete $\gamma_1$ single phase due to either the alloy composition or heat treatment applied thereto is as follows: namely, while the Fe—Pt binary alloy has a completely ordered lattice when its composition is Fe:Pt=50:50 in terms of the number of atoms, in the invention the iron content of the alloy slightly increases so as to produce the incompletely ordered lattice of the $\gamma_1$ phase. The incomplete $\gamma_1$ phase can be also obtained by a heat treatment comprising either quenching alone or a combination of quenching and reheating thereafter, which heat treatment brings about the initial stage of transformation from $\gamma$ phase to $\gamma_1$ phase of ordered lattice.

When a permanent magnet is formed by using the alloy of the above-mentioned composition through a method to be described hereinafter, the crystal structure of the alloy magnet is either one of the following single phase and two-phases; namely, the incomplete $\gamma_1$ single phase of a face-centered tetragonal system due to either the alloy composition or heat treatment applied thereto, and two-phases formed of a $\gamma$ phase matrix of a face-centered cubic system and homogeneously dispersed fine precipitate of $\gamma_1$ phase. Regardless of the single or two phases structure, the permanent magnet of the invention has the desired magnetic properties, namely, a coercive force of larger than 500 Oe, a residual magnetic flux density of larger than 5 kG, and a maximum energy product of larger than 2 MGOe.

The details of the method of the invention for producing the above-mentioned permanent magnet will be described now step by step.

(A) Starting materials are measured so as to form a metallic mixture with a composition consisting of 48~66.9 Atm % of iron, 33~47 Atm % of platinum, 0.1~10 Atm % of niobium, and less than 0.5 Atm % of impurities. The metallic mixture is melted by a suitable furnace and thoroughly stirred so as to produce a molten alloy with a homogeneous composition. An alloy body is formed by using a suitable mold, and it may be further processed into a desired shape by wire-drawing, forging or rolling. The alloy body is heated at 900°~1,400° C. for one minute to ten hours for homogenization and solid solution treatment, and quenched at a high speed of faster than 30° C./minute but slower than 2,000° C./second. The quenching process is to stabilize one of the following structures at room temperature; namely, a structure corresponding to the initial stage of the transformation from $\gamma$ phase of a face-centered cubic system to the $\gamma_1$ phase of face-centered tetragonal system, or a structure formed of fine precipitate of $\gamma_1$ phase of ordered lattice homogeneously dispersed in the $\gamma$ phase matrix of disordered lattice.

(B) After the quenching of the above step (A), the alloy body is reheated at 450°~800° C., preferably 550°~750° C., for one minute to 500 hours, preferably 5 minutes to 100 hours, so as to produce local strain in the solid solution representing the initial stage of the transformation from the disordered $\gamma$ phase to the ordered lattice of $\gamma_1$ phase, which transformation takes place at the high temperature. Thus, magnetic domains in the alloy body are prevented from dislocation, and a permanent magnet having both an ultra-high coercive force and a very high maximum energy product is produced.

(C) Alternatively, after the quenching of the step (A), plastic working with a reduction ratio of larger than 80% may be applied to the alloy body, for instance by wire-drawing or rolling.

(D) After the plastic working of the above step (C), the alloy body is tempered by applying the reheating of the above step (B). In this tempering, the internal strain produced during the plastic working of above step (C) acts to produce suitable local strain and crystal aggregate structures in the course of the transformation into the $\gamma_1$ phase. Whereby, a tendency toward a rectangular magnetic hysteresis curve is enhanced, resulting in a permanent magnet with excellent magnetic properties.

The reasons for selecting the above alloy composition in the present invention will now be explained.

Fe: 48~66.9 Atm %

Basically, the present invention improves the magnetic properties of binary Fe—Pt alloy of even atomic fraction by increasing the iron content therein. If the iron content is less than 48 Atm %, the ratio of Fe and Pt in the alloy composition in terms of Atm % comes close to 50:50, and magnetic properties of the alloy becomes inferior. On the other hand, if the iron content exceeds 66.9 Atm %, the alloy tends to lose its magnetic properties. Thus, 48~66.9 Atm % is chosen.

Pt: 33~47 Atm %

If the platinum content is less than 33 Atm %, the alloy loses its magnetic properties. On the other hand, if the platinum content exceeds 47 Atm %, the ratio of Fe and Pt in the alloy composition in terms of Atm % comes close to 50:50, and magnetic properties of the alloy become inferior. Thus, 33~47 Atm % is chosen.

Nb: 0.1~10 Atm %

Niobium improves the reproducibility of the magnetic properties. If the niobium content is less than 0.1 Atm %, the desired reproducibility cannot be achieved. On the other hand, if the niobium content exceeds 10 Atm %, magnetic properties of the alloy become inferior. Thus, 0.1~10 Atm % is chosen.

It is noted that a preferable content of platinum is 34~43 Atm % in combination with a preferably niobium content of 0.3~5 Atm %.

The conditions for the homogenizing solid solution treatment according to the present invention will be now explained.

As to the temperature for the homogenizing solid solution treatment, the order-disorder transformation point of the alloy with the composition of the invention is 800°~900° C., depending on the composition, and its melting point is about 1,550° C. If the temperature for the homogenizing solid solution treatment is below 900° C., the $\gamma_1$ phase of ordered lattice remains, and single $\gamma$ phase of disordered lattice cannot be obtained. On the other hand, if the temeprature for the treatment is above 1,400° C., which is close to its melting point, the alloy melts. Thus, the range of 900~1,400° C. is chosen for the homogenizing solid solution treatment.

If the duration of the homogenizing solid solution treatment is shorter than one minute, satisfactory homogeneity cannot be achieved even when the temperature for the treatment is 1,400° C. On the other hand, ten hours of homogenizing heat-treatment results in satisfactory homogeneity even when the temperature for the treatment is 900° C., and treatment longer than ten hours does not produce any meaningful improvement. Thus, the duration of one minute to ten hours is chosen for the homogenizing heat-treatment.

As to the cooling speed from the high temperature for the homogenizing solid solution treatment, the faster the better. When the cooling speed is slower than 30° C./minute, the dispersed fine precipitates of $\gamma_1$ phase of ordered lattice tend to grow into excessively large $\gamma_1$ phase crystals so as to hamper the improvement of the magnetic properties. The upper limit of the cooling speed is selected at 2,000° C./second because this is about the technical limit of the quenching and no improvement is expected from cooling faster than this upper limit. Thus, the cooling speed of 30° C./minute to 2,000° C./second is chosen for the cooling speed from the high temperature of the homogenizing solid solution treatment.

The conditions for the reheating for tempering after the quenching will now be described. If the reheating temperature is below 450° C., the reheating time which is necessary for achieving the desired tempering effects become too long, i.e., more than 500 hours. Such long heating is uneconomical and any meaningful improvement of magnetic properties cannot be expected from it. On the other hand, reheating at a temperature higher than 800° C. tends to accelerate the formation of ordered lattice, resulting in an inferior magnetic properties. Thus, the range of 450°~800° C. is chosen for the tempering. The inventors have found that a more preferable range for the tempering is 550°~750° C.

If the reheating is shorter than one minute, satisfactory tempering for improving the magnetic properties cannot be achieved even when the temperature for the reheating is 800° C. On the other hand, reheating of longer than 500 hours tends to accelerate the formation of ordered lattice and hamper the improvement of the magnetic properties. Thus, the duration of one minute to 500 hours is chosen for the reheating for the tempering treatment.

When plastic working, such as wire-drawing or rolling, is applied before the tempering, if the reduction ratio is less than 80%, the internal strain which is expected to be caused by such plastic working is too small to improve the magnetic properties. thus, the reduction ratio in the plastic working is selected to be more than 80%.

The cooling at the end of the reheating for tempering can be either quick or slow, but quick cooling is preferable.

BRIEF DESCRIPTION OF THE DRAWINGS

For a better understanding of the invention, reference is made to the accompanying drawings, in which.

DESCRIPTION OF THE PREFERRED EMBODIMENT

Figure 1:
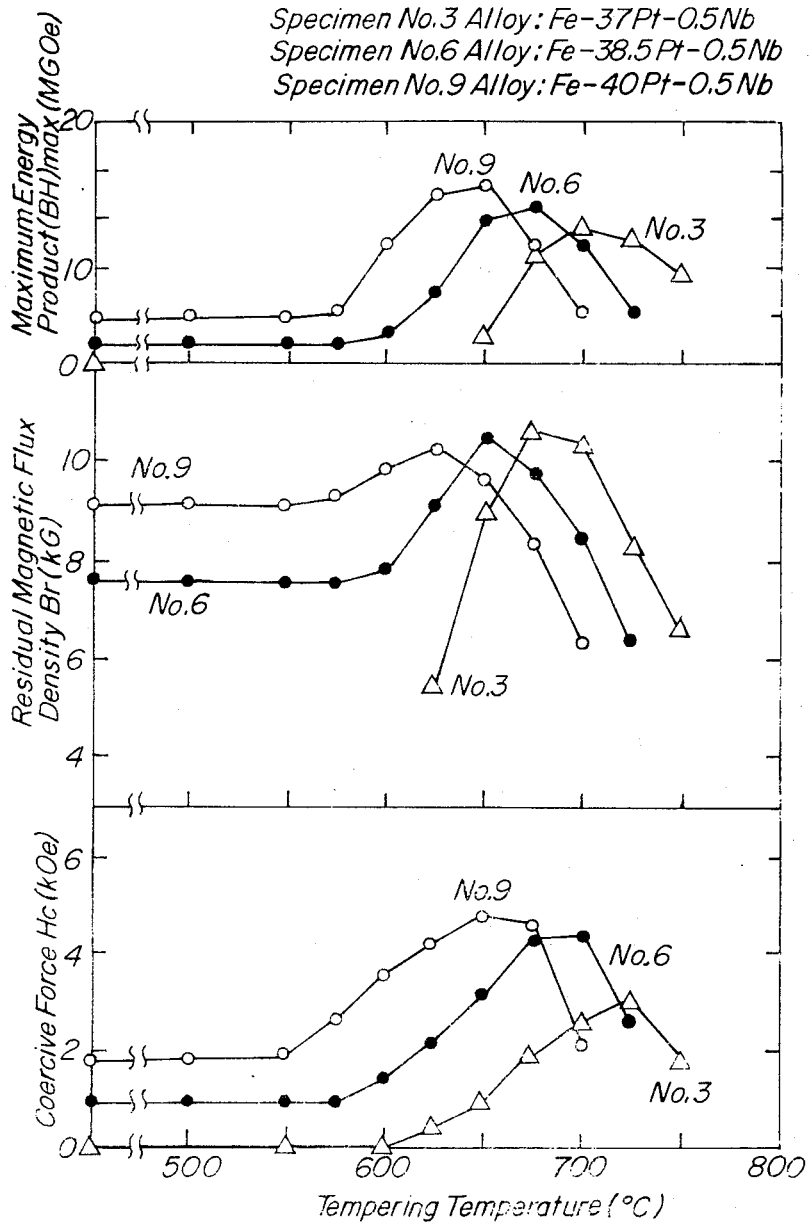
FIG. 1 is a graph showing the relation between the reheating temperature and magnetic properties for three kinds of alloy containing 37~40 Atm % of platinum, and 0.5 Atm % of niobium.

Specimens of alloys with compositions of Table 1 were prepared in the following manner by using electrolytic iron with a purity of 99.9%, platinum and niobium. Namely, the starting materials of 10 g in total with a desired composition were measured and loaded in an alumina Tammann tube, and the materials were melted in a Tammann furnace while blowing argon gas therein. The melt was thoroughly agitated so as to produce a homogeneous molten alloy, and the molten alloy was sucked into a quartz tube with a diameter of 2.0~3.8 mm so as to form a round alloy rod. Similar round alloy rods were prepared for different alloy compositions as shown in Table 1. Specimens for different alloys were made by cutting the round alloy rods at a length of 25 mm.

The Specimens were homogenized by heating at 900°~1,400° C. for about one hour, and homogenized Specimens were quenched either by water quenching or by cooling in air. Some of the Specimens were tested after the quenching without being tempered, while other Specimens were tempered under the coditions of Table 1 before testing.

The Specimens thus treated were tested to check their magnetic properties. Specimens No. 2, No. 3and No. 14 of Table 1 were drawn into wires after the quenching, and then they were tempered and tested. The result of the test is also shown in Table 1.

TABLE 1

| Specimen No. | Composition (Atm %) Fe | Pt | Nb | Quench* | Tempering Temperature (°C.) | Time (hr) | Mag. Properties** Hc (kOe) | Br (kG) | (BH)max (MGOe) |
|---|---|---|---|---|---|---|---|---|---|
| 2 | 63.0 | 36.5 | 0.5 | a | 630 | 100 | 2.8 | 11.0 | 10 |
| | | | | c | 630 | 70 | 3.2 | 11.5 | 11 |
| 3 | 62.5 | 37.0 | 0.5 | a | 630 | 100 | 3.5 | 10.9 | 14.5 |
| | | | | c | 630 | 70 | 3.6 | 11.0 | 15.5 |
| 5 | 61.5 | 38.0 | 0.5 | a | 620 | 100 | 4.0 | 10.6 | 18 |
| | | | | b | 600 | 50 | 3.5 | 10.6 | 13 |
| 6 | 61.0 | 38.5 | 0.5 | a | 620 | 100 | 4.5 | 10.5 | 19 |
| | | | | a | not tempered | not tempered | 1.2 | 7.7 | 3 |
| 7 | 60.5 | 39.0 | 0.5 | a | 610 | 100 | 4.8 | 10.7 | 21 |
| | | | | a | not tempered | not tempered | 1.5 | 8.5 | 3.5 |
| | | | | b | 600 | 50 | 4.0 | 10.0 | 17 |
| 8 | 60.0 | 39.5 | 0.5 | a | 610 | 150 | 5.2 | 11.0 | 22 |
| | | | | a | not tempered | not tempered | 1.8 | 9.2 | 4 |
| 9 | 59.5 | 40.0 | 0.5 | a | 610 | 200 | 5.4 | 10.0 | 20 |
| | | | | a | not tempered | not tempered | 2.5 | 10.0 | 6 |
| 10 | 58.5 | 41.0 | 0.5 | a | 610 | 100 | 5.0 | 8.5 | 13.5 |
| | | | | a | not | not | 3.0 | 8.0 | 4 |

TABLE 1-continued

| Specimen No. | Composition (Atm %) Fe | Pt | Nb | Quench* | Tempering Temperature (°C.) | Time (hr) | Mag. Properties** Hc (kOe) | Br (kG) | (BH)max (MGOe) |
|---|---|---|---|---|---|---|---|---|---|
| | | | | | tempered | tempered | | | |
| 14 | 62 | 37 | 1 | a | 625 | 50 | 3.2 | 10.0 | 13 |
| | | | | c | 625 | 30 | 3.5 | 10.5 | 15 |
| 16 | 61 | 38 | 1 | a | 600 | 200 | 3.8 | 10.8 | 17 |
| 18 | 60 | 39 | 1 | a | 600 | 200 | 4.7 | 10.6 | 21 |
| | | | | b | 610 | 50 | 4.0 | 10.0 | 16 |
| 20 | 59 | 40 | 1 | a | 600 | 150 | 4.5 | 9.5 | 18 |
| 23 | 61 | 37 | 2 | a | 620 | 150 | 2.5 | 10.0 | 9 |
| 24 | 60 | 38 | 2 | a | 610 | 150 | 3.5 | 10.0 | 16 |
| 25 | 59 | 39 | 2 | a | 610 | 100 | 4.0 | 9.5 | 17 |
| 31 | 59 | 38 | 3 | a | 620 | 70 | 3.0 | 10.0 | 10 |
| 33 | 58 | 39 | 3 | a | 610 | 80 | 3.7 | 9.6 | 12 |
| 40 | 56 | 39 | 5 | | 610 | 70 | 2.8 | 8.0 | 6 |

*a: water quenched
b: cooled in air
c: wire-drawn after being water quenched
**Hc: coercive force
Br: residual magnetic flux density
(BH)max: maximum energy product As can be seen from Table 1, those Specimens with compositions of the invention which were treated under the conditions of the invention proved to have an ultra-high coercive force, a high residual magnetic flux density, and a very large maximum energy product.

FIG. 1 shows the effects of tempering on magnetic properties for three Specimens having different alloy compositions; namely, Specimen No. 3 (Fe—37-Pt—0.5Nb), No. 6 (Fe—38.5Pt—0.5Nb), and No. 9 (Fe—40Pt—0.5Nb). The three Specimens were tempered for the same duration of two hours at different temperatures in a range of 500°~750° C. As can be seen from the figure, the tempering temperature for producing a high coercive force varied depending on the alloy composition. In the case of Specimens No. 6 and No. 9 whose platinum contents were 38.5 Atm % and 40 Atm %, the quenching alone provided a fairly large coercive force, and the tempering proved to further improve their coercive forces to very large values of 3.5~5.2 kOe. When such very large coercive forces were provided, their residual magnetic flux densities were 10.9–10 kG and their maximum energy products were 14.5~20 MGOe.

Figure 2:
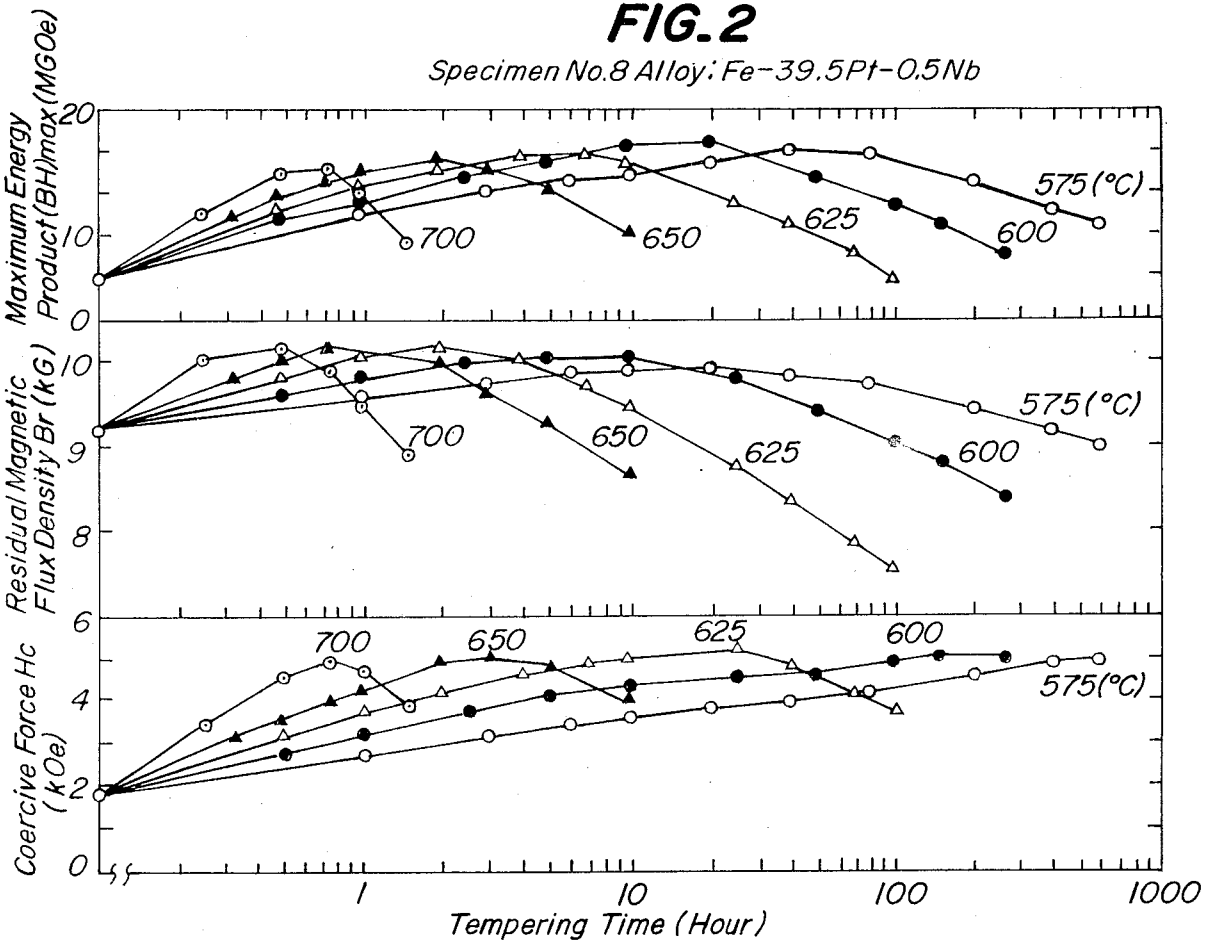
FIG. 2 is a graph showing the relation between the reheating conditions, i.e., temperature and duration, and magnetic properties for Specimen No. 8 of the alloy according to the invention, which Specimen is a typical example of the alloy of the invention and contains 39.5 Atm % of platinum and 0.5 Atm % of niobium.

As shown in Table 1 and FIG. 2, among the Specimens tested, Specimen No. 8 (Fe—39.5Pt—0.5Nb) showed the largest maximum energy product, which was 22 MGOe. The inventors found that the Specimen No. 8 showed an extremely large maximum energy product of 26 MGOe when it was cooled to a very low temperature (−196° C.) by using liquid nitrogen.

It is noted that plastic working is possible in the case of the alloy of the invention. The tests showed that permanent magnets formed by plastic working had better magnetic properties than those without the plastic working.

FIG. 2 shows the relation between the magnetic properties and the conditions for constant-temperature tempering, i.e., the heating temperature and duration, for Specimen No. 8 (Fe—39.5Pt—0.5Nb) which is a typical alloy of the invention. In the case of this Specimen, when the temperature for the tempering is low, a long duration of heating treatment is necessary to achieve good magnetic properties.

Figure 3:
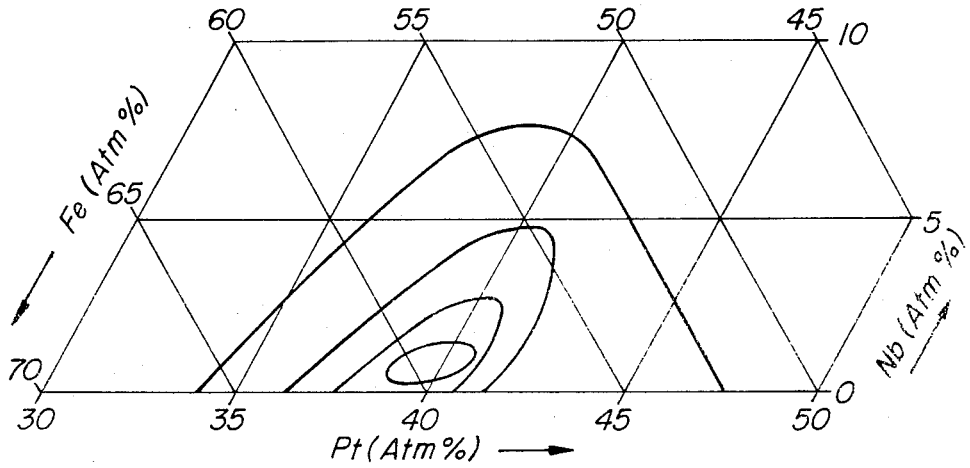
FIG. 3, FIG. 4 and FIG. 5 are diagrams showing the relation between the composition and magnetic properties for the Fe—Pt—Nb ternary alloys according to the invention.
Figure 4:
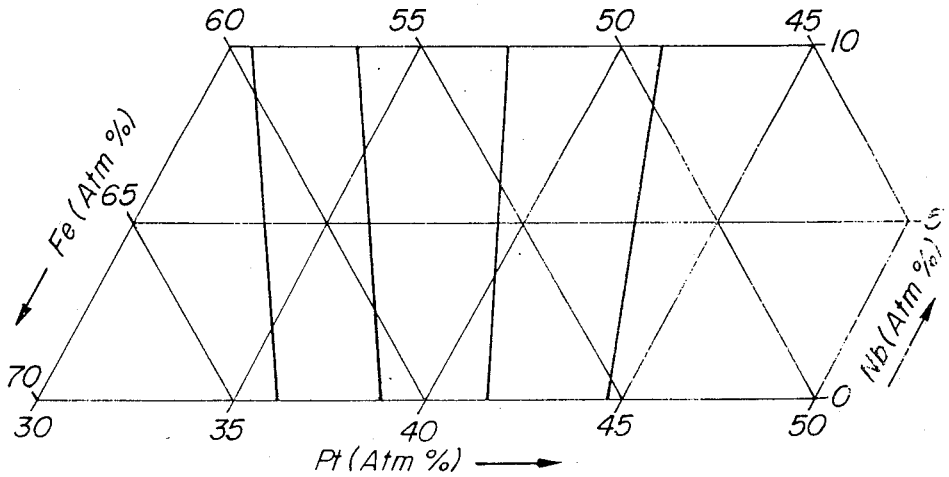
Figure 5:
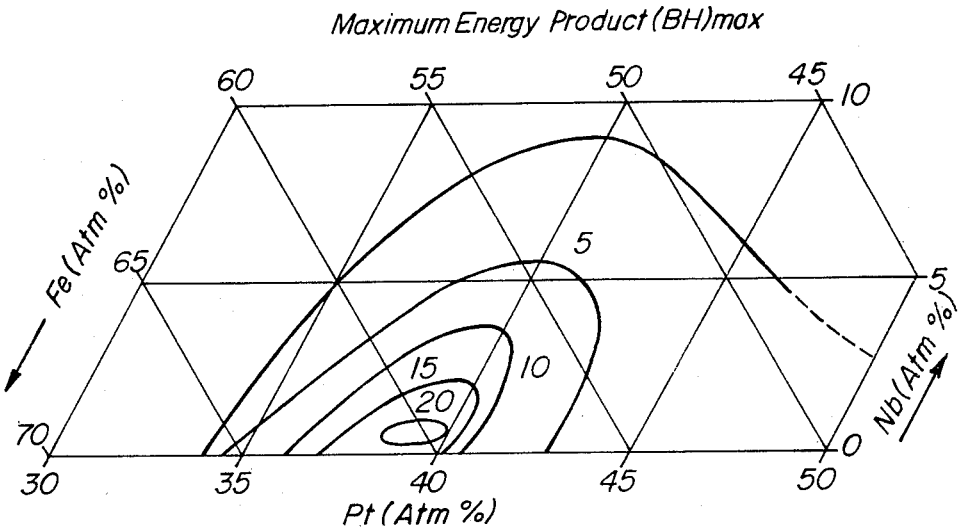

FIG. 3 shows the relation between the compositions of the Fe—Pt—Nb ternary alloys and their coercive forces. FIG. 4 shows the relation between the compositions of the Fe—Pt—Nb ternary allows and their residual magnetic flux densities. FIG. 5 shows the relation between the compositions of the Fe—Pt—Nb ternary alloys and their maximum energy products.

Figure 6:
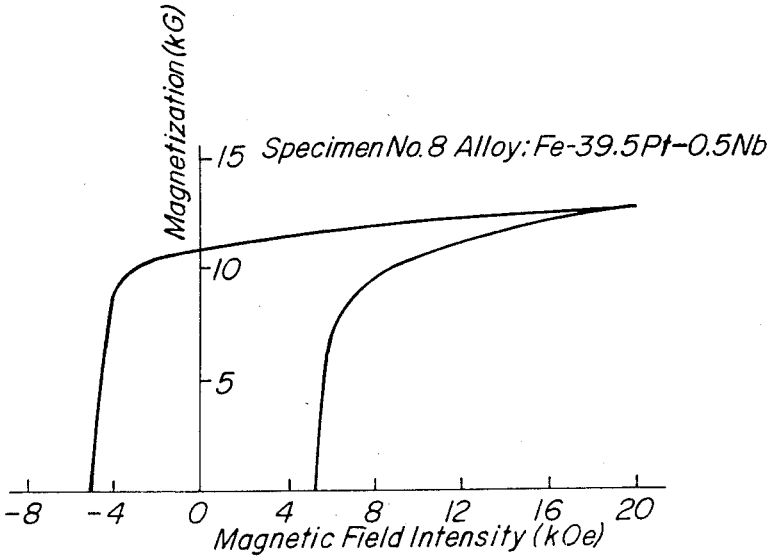
FIG. 6 is a demagnetization curve of the above-mentioned Specimen No. 8 of the alloy according to the invention after tempering under the conditions a of Table 1 to be described hereinafter.

FIG. 6 illustrates the demagnetizing curve for Specimen No. 8 (Fe—39.5Pt—0.5Nb) whose residual magnetic flux density and coercive force were high and whose maximum energy product proved to the largest among the tested Specimens. The alloy of Specimen No. 8 was easy to work, and it was found to be suitable for both small magnets with complicated shape and magnets to be used at a temperature considerably lower than room temperature.

Figure 7:
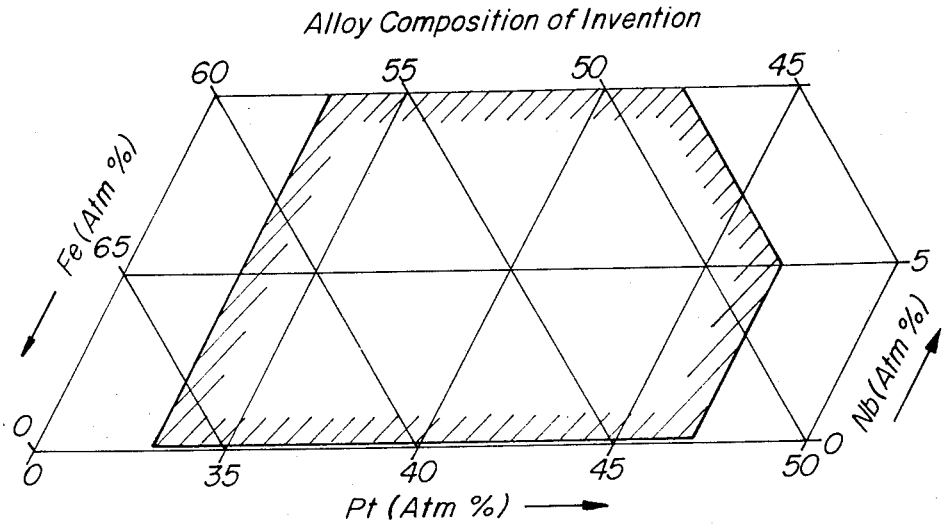
FIG. 7 is an alloy composition diagram in which the range of alloy composition according to the invention is shaded.

The shaded area of FIG. 7 summarizes the composition of the alloy for the permanent magnet according to the invention.

As described in detail in the foregoing, the permanent magnet of the invention can be produced by very simple heat-treatment, and it has a high workability due to its composition consisting of iron, platinum and a small amount of niobium. Furthermore, the permanent magnet of the invention provides an ultra-high coercive force and the very large maximum energy produce which are of great value in various industries.

Although the invention has been described with a certain degree of particularity, it is understood that the present disclosure has been made only by way of example and that numerous changes in details may be resorted to without departing from the scope of the invention as hereinafter claimed.

What is claimed is:

1. A permanent magnet consisting essentially of 48 to 66.9 atomic (Atm) % of iron 33 to 47 Atm % of platinum, 0.1 to 10 Atm % of niobium, and less than 0.5 Atm % of impurities and having a coercive force of larger than 500 Oe (oersted), a residual magnetic flux density of larger than 5 kG (kilo·Gauss), and a maximum energy product of larger than 2 MGOe (Mega·Gauss·Oersted), said permanent magnet having a crystal structure of incomplete single $\gamma_1$ phase of face-centered tetragonal system due to either composition thereof or heat-treatment applied thereto.

2. A permanent magnet consisting essentially of 48 to 66.9 atomic (Atm) % of iron, 33 to 47 Atm % of platinum, 0.1 to 10 Atm % of niobium, and less than 0.5 Atm % of impurities and having a coercive force of larger than 500 Oe, a residual magnetic flux density of larger than 5 kG, and a maximum energy produce of larger than 2 MGOe, said permanent magnet having a two-phase, crystal structure formed of a $\gamma$ phase matrix of face-centered cubic system and homogeneously dispersed fine precipitate of $\gamma_1$ phase.

* * * * *